US006018844A

United States Patent [19]

Basham et al.

[11] Patent Number: 6,018,844

[45] Date of Patent: Feb. 1, 2000

[54] COMPOSITE SIDE SKIRT FOR POWERED SWEEPER

[75] Inventors: Michael T. Basham, Maple Grove; Joseph F. D'Costa, New Hope; Todd M. Engel, Eagan; Thomas E. Johansson, Brooklyn Park, all of Minn.

[73] Assignee: Tennant Company, Minneapolis, Minn.

[21] Appl. No.: 09/162,807

[22] Filed: Sep. 29, 1998

[51] Int. Cl.[7] ..... E01H 1/08

[52] U.S. Cl. ..... 15/349; 14/246.2; 14/340.3; 14/375

[58] Field of Search ..... 15/347, 349, 346, 15/420, 421, 246, 246.2, 385, 339, 375

[56] References Cited

U.S. PATENT DOCUMENTS

| | | | |
|---|---|---|---|
| 3,719,966 | 3/1973 | Lamont | 15/385 |
| 4,320,556 | 3/1982 | Kimzey et al. | 15/346 X |
| 4,450,601 | 5/1984 | Shwayder | 15/246 |
| 4,580,314 | 4/1986 | Anleitner | 15/346 X |
| 4,872,233 | 10/1989 | Brown | 15/246 X |
| 4,951,342 | 8/1990 | Wilson | 15/246 |
| 5,392,492 | 2/1995 | Fassauer | 15/346 X |
| 5,659,921 | 8/1997 | Narayan | 15/349 |

*Primary Examiner*—Chris K. Moore
*Attorney, Agent, or Firm*—Dorn, McEachran, Jambor & Keating

[57] ABSTRACT

A sweeping machine has a wheel supported body and a rotatable brush mounted transversely of the direction of machine movement. There is a debris hopper adjacent the brush and a dust collection chamber on the body. A vacuum fan draws dust laden air from the area about the brush, through the debris hopper, and into the dust collection chamber. The improvement comprises a dust control side skirt assembly mounted on each side of the body generally in alignment with the brush. Each such assembly includes a flexible inner skirt and a flexible outer skirt spaced from the inner skirt. A flexible spacer extends between and is attached to the inner and outer skirts, with the spacer and skirts defining a cavity which has an air opening at a lower portion of the side skirt assembly. The air opening is formed by a discontinuity in the spacer. There is an opening in the inner skirt connecting the cavity with the area about the brush whereby the vacuum fan creates an airflow path through the air opening, into the cavity, through the inner skirt opening and into the debris hopper and dust collection chamber.

11 Claims, 2 Drawing Sheets

Fig. 2.
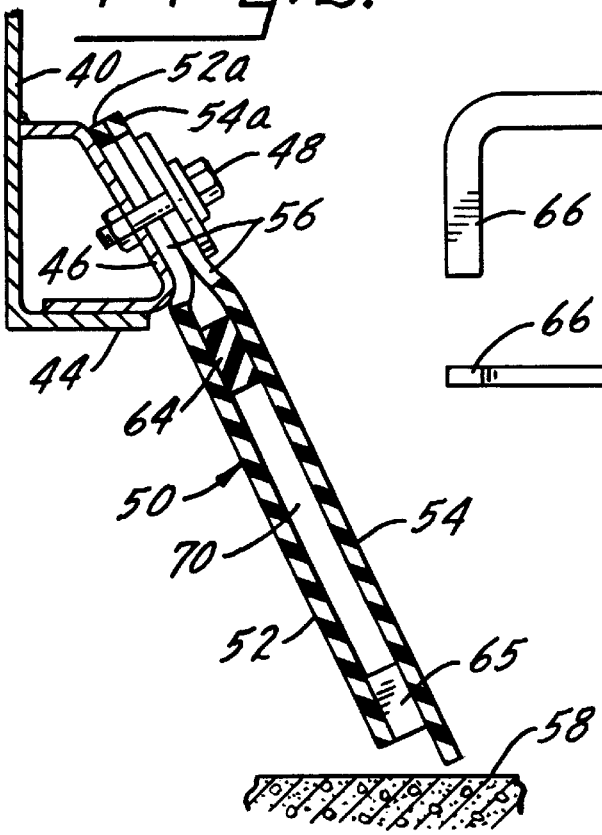
Fig. 5.
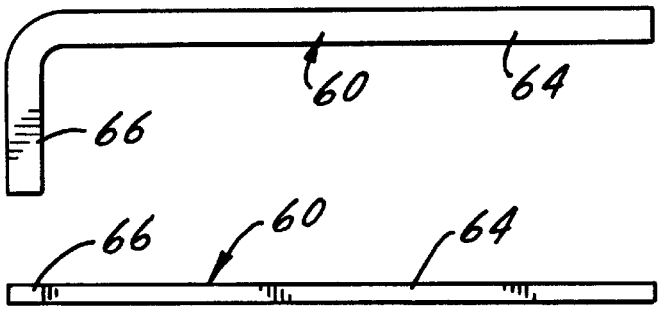
Fig. 6.
Fig. 7.
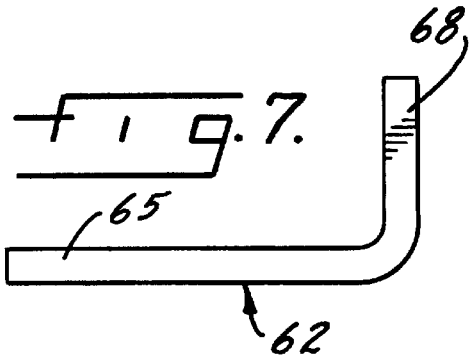
Fig. 3.
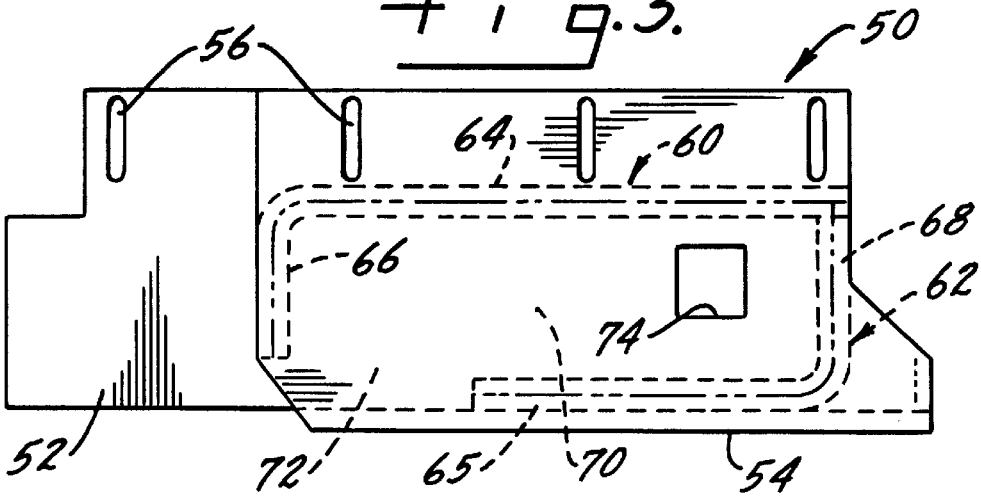
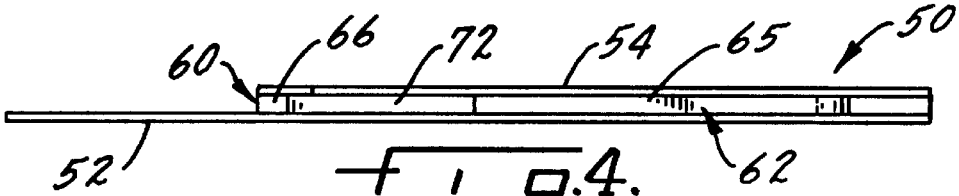
Fig. 4.

COMPOSITE SIDE SKIRT FOR POWERED SWEEPER

THE FIELD OF THE INVENTION

The present invention relates to sweeping machines of the type shown in U.S. Pat. Nos. 3,892,008, 5,394,586 and 5,659,921. More specifically, the invention relates to a side skirt assembly of the type shown in the '921 patent. Sweeping machines carry a pair of side skirt assemblies, one at each end of the main sweeping brush.

During operation of a sweeper dust laden air stirred up by the brush bristles as they contact the ground is largely contained within the brush chamber, which is the area surrounding the brush. If it does find its way outside the brush chamber, it forms an objectionable dust cloud emanating from the sweeper, commonly called dusting.

A suction fan maintains a negative pressure in the brush chamber, which sets up a flow of ambient, external air into the brush chamber from underneath the side skirts. This flow of air does not permit the brush-generated dusty air from exiting the brush chamber. An exception to this is a narrow region at the ends of the brush where the spinning brush first comes into contact with the ground. In this small region the brush generates an air pressure above atmospheric, and the vacuum air flow mentioned is not sufficiently strong to prevent the brush-generated flow of air from escaping under the side skirts and into the atmosphere. But the air flow generated in the side skirt assembly disclosed herein is sufficiently strong to entrain the dust laden air in this region and transport it into a lower pressure region in the brush chamber via the air flow passageway formed in the side skirt assembly, thereby preventing it from escaping into the surrounding atmosphere.

The side skirt assembly of the present invention includes an inner skirt and an outer skirt, both of which are flexible and are formed of a rubber or rubberlike material. There is an elastic or flexible spacer bonded to the inside of the outer skirt and the outside of the inner skirt to form a composite skirt assembly. The attachment of the spacer to the inner and outer skirts may be done by bonding, sewing or any other suitable manner. The spacer forms and defines the outline of a cavity between the skirts. There is an air opening at the lower rear of the cavity defined by a discontinuity in the spacer and there is an air outlet from the cavity formed by an opening in the inner skirt. Thus, the air flow will be from the lower rear air entrance to the cavity, through the side skirt cavity, and then into a forward area in the brush chamber where the adjacent brush bristles are moving up and tend to aspirate air out of the cavity into the brush chamber. This flow of air through the side skirt assembly disclosed herein will effectively eliminate dusting at the ends of the brush.

SUMMARY OF THE INVENTION

The present invention relates to sweeping machines and more specifically to a side skirt assembly for a sweeping machine.

A primary purpose of the invention is a side skirt assembly for a sweeping machine having a rotatable brush, which side skirt assembly is flexible, returns to its original shape after distortion during use and has flexible inner and outer skirts.

Another purpose is a side skirt assembly as described in which the flexible inner and outer skirts are formed of a rubber or rubberlike material.

Another purpose is a side skirt assembly as described in which the inner and outer skirts are joined together by a flexible resilient spacer which is in the form of a small rectangular element having a discontinuity for an ambient air entrance into the space between the skirts. There is an outlet from the space between the skirts formed in the inner skirt.

Another purpose is a reliable, simply constructed side skirt assembly for a sweeping machine of the type described which uses a flexible spacer between two flexible side skirts to form an air cavity which has an air entrance formed by a discontinuity in the spacer and an outlet from the cavity formed by an opening in the inner skirt.

Other purposes will appear in the ensuing specification, drawings and claims.

BRIEF DESCRIPTION OF THE DRAWINGS

The invention is illustrated diagrammatically in the following drawings wherein:

FIG. 2 is a section along plane 2—2 of FIG. 1;

FIG. 3 is a side view of an unattached left side skirt assembly;

FIG. 4 is a bottom view of the side skirt assembly of FIG. 3;

FIG. 5 is a side view of one of the spacing elements;

FIG. 6 is a bottom view of the spacing element of FIG. 5; and

FIG. 7 is a side view of a second spacing element.

DESCRIPTION OF THE PREFERRED EMBODIMENT

Figure 1:
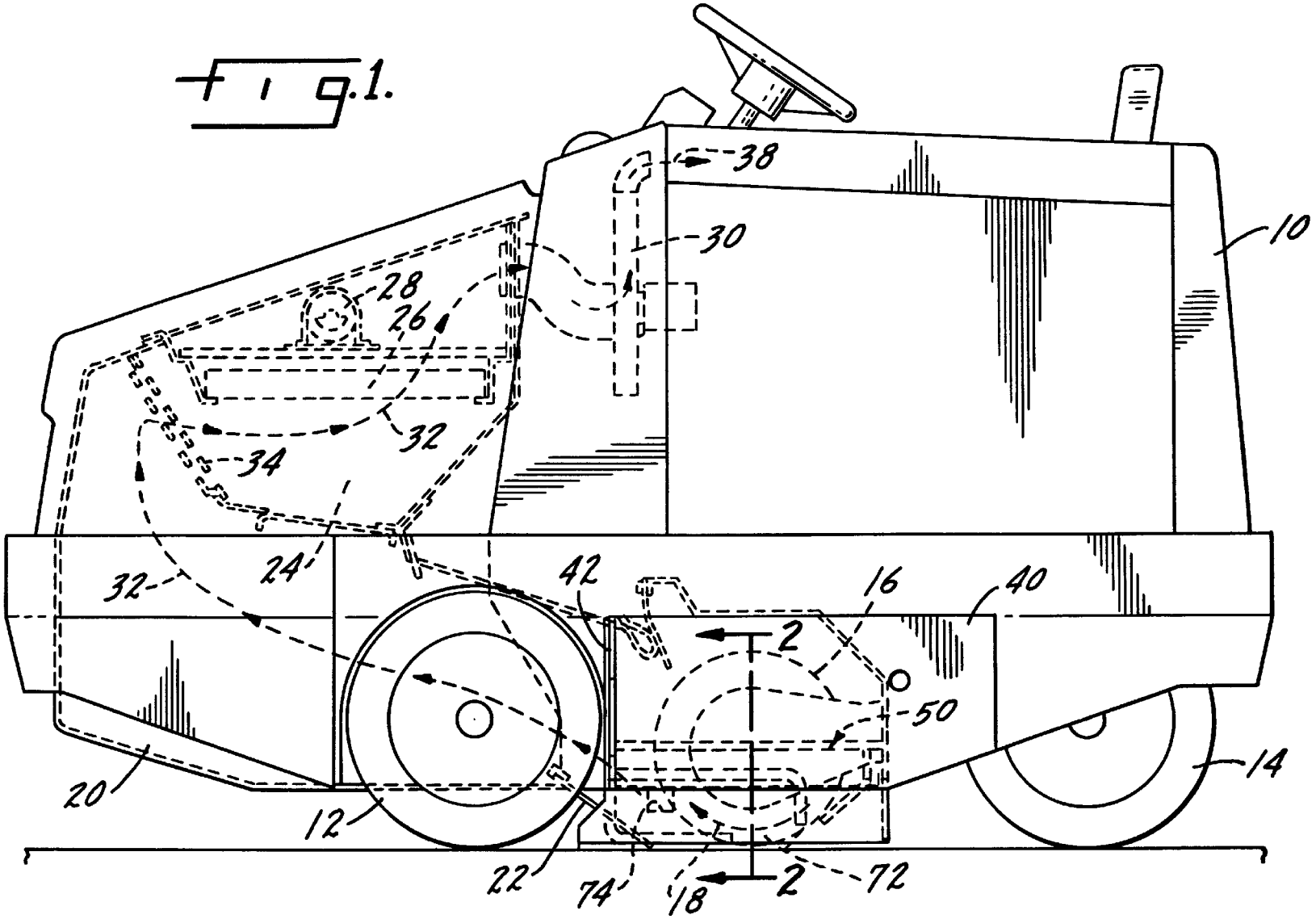
FIG. 1 is a diagrammatic illustration of a sweeping machine with many of the internal parts being shown in phantom.

The invention disclosed herein is a side skirt assembly typically found on a powered sweeping machine with vacuumized dust control such as the Tennant Model 385 sweeper. Tennant Company is the assignee of the present application and is also the owner of U.S. Pat. No. 5,659,921 showing an earlier form of side skirt assembly.

The composite skirt which forms the side skirt assembly is a combination of an inner skirt, an outer skirt, both formed of a flexible sheet material such as rubber or a rubber substitute, and a flexible spacer sandwiched therebetween. Every sweeping machine has installed on its frame a pair of side skirts, one at the right end and one at the left end of the main brush. The two skirts are mirror images of each other, but otherwise are identical, so a description will be given of the skirt at the left end of the main brush relative to normal forward travel, and it will be understood that the description could also apply to the right skirt.

During sweeper operation dust laden air is stirred up by the brush bristles as they contact the ground. For the most part such dusty air is largely contained within the brush chamber, which is the area around the brush, by an air exhaust system that creates negative pressure in that chamber that sets up a flow of ambient air into the brush chamber from underneath the side skirts. This flow of air does not permit the brush generated dusty air to exit from the brush chamber. An exception to this is a narrow region where the spinning brush first comes into contact with the ground. In this small region the brush generates above atmospheric air pressure, and the vacuum air flow is not sufficiently strong to prevent the brush generated flow from escaping into the atmosphere. However, the air flow generated by the composite skirt assembly of the present invention is sufficiently strong to entrain the dust laden air in this region and transport it into the brush chamber via the passageway in the side skirt assembly to be described herein, thereby preventing it from escaping to the surrounding environment.

During a sweeping operation, debris can accumulate in the brush chamber just ahead of the brush. This accumulation of debris exerts a sideways push on the side skirts. Accumulation of heavier debris such as pea gravel can cause prior art side skirts to bow out in a transverse direction, thereby spilling the debris beyond the width of the brush. The debris trails along the sides of the machine. The composite skirt described herein, due to its laminated construction, is flexurally stiffer and resists transverse deformation better than a conventional skirt. Prior art sweeping machines sometimes also utilize a short length of stiffer skirting, called a pea gravel skirt, in conjunction with the primary side skirt. The function of this auxiliary skirt is to resist the transverse deflection and thus prevent trailing. The composite skirt of the present invention eliminates the need for a pea gravel skirt.

The side skirt assembly of the present invention is disposed parallel to the direction of travel of the sweeper. There is a clearance of ⅛" to ¼" between the lower edge of the skirts and the ground. However, uneven, non-flat terrain can cause the skirts to drag on the ground along their length. A flat, flexible piece of skirting fixed along an upper edge and hanging without a support along its lower edge, cannot effectively resist in-plane loading such as that induced by ground drag. This loading can cause out-of-plane deformation. Frequently the skirts sag and/or take on a permanent set with their planar surface showing undulations. Any and all such deviations of the skirt surfaces from the original configuration can cause side trailing as well as dusting.

In the prior art there is mention of using relatively thicker skirts. Such thicker skirts cannot deflect out of the way of obstructions on the ground as easily as a more flexible thinner skirt. This can result in skirt tear and/or the skirt being forced out of its properly aligned position on the sweeper. In the present invention, due to the elastic strip sandwiched between and bonded or otherwise attached to the two flat flexible skirts forming the composite skirt structure, the structural properties are very different from single or unbonded double skirts. On being deformed the side skirt assembly of the present invention will be turned back to its original configuration by the elastic spacing element and the skirts attached to it remain relatively free from warp. The functionality and reliability of the skirt assembly is thus enhanced and insured.

In FIG. 1 the sweeping machine is indicated to have a body shown generally at 10, and supporting wheels 12 and 14. As is conventional in machines of this type, there may be two forward driving wheels and a single rear wheel, although the invention should not be so limited. There is a rotatable brush 16 which extends transversely across the body of the machine and, as illustrated by the arrow 18, will be rotated in a clockwise direction to direct dust and debris forwardly into a debris collection chamber or hopper indicated generally at 20. There is a ramp 22 which defines the entrance to the debris chamber 20, with the debris chamber being forward of the brush as is customary in forward throw sweeping machines. Positioned above and slightly forward of the debris chamber 20 is a dust collection chamber 24 having a filter assembly 26 therein, with the filter assembly having a movable shaker 28 mounted thereon. Further details of the sweeper are shown in U.S. Pat. No. 5,503,488 and 5,659,921, assigned to Tennant Company of Minneapolis, Minn., with the disclosure of both said patents being expressly incorporated by reference herein.

Above and to the rear of the dust collection chamber 24 is a vacuum fan indicated diagrammatically at 30, with the vacuum fan creating an air flow path indicated by the series of arrows designated at 32. The air flow path begins directly adjacent the forward throwing sweeping brush 16, passes through the debris chamber 20, then through a series of baffles 34 into the dust collection chamber 24. The air flow path then passes through the filter 26 and exhausts from the vacuum fan as illustrated by arrows 38. The described dust control system is conventional in sweeping machines of this type.

The side skirt assembly may be attached to the door 40 which is hinged along its front edge 42 and which covers the end of the sweeping brush and provides access thereto for maintenance and cleaning. The door 40 will carry the side skirt assembly of the present invention through a lower inwardly extending flange 44 which carries a support bracket 46. Bolts or other suitable types of fasteners indicated at 48 attach the side skirt assembly indicated generally at 50 to the bracket 46.

The side skirt assembly includes an outer skirt 52 and an inner skirt 54. Both skirts are formed of rubber, a rubber substitute, or a similar type of flexible material. The tops of the outer and inner skirts, as indicated at 52*a* and 54*a*, will be flat against each other where the side skirt assembly is joined by the bolts 48, through the openings 56, to the bracket 46. The lower edges of skirts 52 and 54 will be nominally ⅛" to ¼" above a surface 58 to be swept, but this may vary slightly.

The skirt assembly is formed of a composite combination of elements which include the outer and inner skirts 52 and 54 and a flexible resilient spacer formed of a first spacing element 60 and a second spacing element 62. The spacing elements 60 and 62 may be bonded, sewn or otherwise permanently attached to the outer surface of the inner skirt 54 and the inner surface of the outer skirt 52. Spacing element 60 has a horizontal portion 64 and a vertical portion 66. Spacing element 62 has a vertical portion 68 and a horizontal portion 65. The disposition of the two spacing elements within the side skirt assembly is illustrated in FIG. 3. Together, the skirts and the spacing elements define an air cavity 70. The upper end of the vertical portion 68 of spacing element 62 abuts and joins the end of the horizontal portion 64 of spacing element 60. There is a discontinuity or space 72 between the end of horizontal portion 65 of spacing element 62 and the lower end of vertical portion 66 of spacing element 60. This discontinuity or opening 72 forms an air entrance into the cavity 70. Air exits from the cavity through an opening 74 in the inner skirt 54.

The vacuum fan 30 creates an airflow path through the sweeper as described earlier. In general it creates less than ambient air pressure around the brush, which causes external ambient air to flow under the skirts and into the brush chamber, thereby preventing dusty air stirred up by the brush from escaping outward into the surrounding atmosphere. However, as described earlier, there is an area where the rotating brush bristles strike the floor and in so doing generate a local region of above ambient air pressure which tends to push a small amount of dusty air outward under the side skirts at the ends of the brush and into the surrounding environment.

This is prevented by the composite side skirts of the present invention. Instead of moving under the side skirts to the outside environment, this local outward air flow moves into the air inlet 72 of the composite side skirt, moves through the cavity 70 between the inner and outer skirts, and through the opening 74 in the inner skirt back into the brush chamber in front of the brush. The sub-atmospheric pressure in front of the brush provides the pressure gradient to cause this airflow, helped by an aspirating effect as the revolving brush bristles move past opening 74 and tend to pull air out of it. The location of opening 74 relative to the brush is chosen to maximize this aspirating effect.

The side skirt assembly performs an important function by keeping debris from spilling out of the brush chamber as well as providing an air seal so that the brush chamber can be maintained at a negative pressure relative to ambient air to prevent dust laden air from blowing out of the brush chamber. To be able to function effectively, the skirts have to be positioned accurately with respect to the brush and the ground. In practice, the sweeping machine encounters operational conditions that tend to deflect the skirt from its ideal configuration. Uneven terrain can cause the skirts to be dragged on the ground, causing accelerated wear and tear and also warping. The skirts can get snagged and torn or dragged away from their as-assembled position. Any deviation of the side skirt assembly from its desired position can lead to dust puffing, debris trailing and accelerated skirt wear. The present invention provides a skirt system that is tolerant to such misalignment from the as-designed configuration so that its functionality does not deteriorate over a wide range of operational conditions. The composite skirt assembly is low cost, easy to install and maintain. It provides an effective shield to the brush chamber and overcomes many of the problems of the prior art skirts and skirt assemblies.

Whereas the preferred form of the invention has been shown and described herein, it should be realized that there may be many modifications, substitutions and alterations thereto.

The embodiments of the invention in which an exclusive property or privilege is claimed are defined as follows:

1. A sweeping machine having a body, wheels for supporting the body for movement over a surface to be swept, a rotatable brush mounted to the body transversely of the direction of movement of the sweeping machine, a debris hopper adjacent said rotatable brush, a dust collection chamber in said body, a vacuum fan mounted on said body to draw dust laden air from the area about the brush, through said debris hopper and into said dust collection chamber, the improvement comprising a dust control side skirt assembly mounted on each side of said body generally in alignment with said brush, each assembly including a flexible inner skirt and a flexible outer skirt spaced from the inner skirt, a flexible spacer extending between and attached to said inner and outer skirts, said spacer and skirts defining a cavity which has an air opening at a lower portion of said assembly and formed by a discontinuity in said spacer, and an opening in said inner skirt connecting said cavity with the area about said brush assembly whereby said vacuum fan creates an airflow path through said air opening, into said cavity, through said inner skirt opening and into said debris hopper and dust collection chamber.

2. The sweeping machine of claim 1 wherein said spacer is bonded to an inner surface of said outer skirt and to an outer surface of said inner skirt.

3. The sweeping machine of claim 1 wherein said spacer extends peripherally about said cavity except for said discontinuity forming said air opening.

4. The sweeping machine of claim 3 wherein said spacer includes a first spacing element extending both horizontally and vertically and a second spacing element which extends both horizontally and vertically with the vertical portion of said second spacing element terminating at the horizontal portion of said first spacing element.

5. The sweeping machine of claim 4 wherein the air opening spacer discontinuity is formed between an end of the vertical portion of the first spacing element and the end of the horizontal portion of the second spacing element.

6. The sweeping machine of claim 1 wherein said side skirts are formed of a rubber or rubberlike material.

7. A side skirt assembly for use on a sweeping machine having a rotatable brush, with the side skirt assembly being formed and adapted to be mounted generally in alignment with the brush, said side skirt assembly including a flexible inner skirt and a flexible outer skirt spaced from the inner skirt, a flexible spacer extending between and attached to said inner and outer skirts, said spacer and skirts defining a closed cavity which has an air opening at a lower portion thereof formed by a discontinuity in said spacer, and an opening in said inner skirt connecting said cavity with the area about said brush whereby a flow path is created through said side skirt assembly from the air opening, into the cavity, and through said inner skirt opening to the area adjacent an end of said brush.

8. The side skirt assembly of claim 7 wherein said spacer extends peripherally about said cavity except for said air opening.

9. The side skirt assembly of claim 7 wherein said spacer is bonded to said inner and outer skirts to form a composite flexible side skirt assembly.

10. The side skirt assembly of claim 7 wherein said spacer includes a first spacing element having a generally horizontally extending portion and a generally vertically extending portion, and a second spacing element having a generally horizontal extending portion and a generally vertically extending portion, the vertically extending portion of said second spacing element being in contact with and closed upon an end of the horizontally extending portion of said first spacing element.

11. The side skirt assembly of claim 10 wherein the discontinuity in said spacer forming said air opening is defined by a lower end of the vertically extending portion of the first spacing element and an end of the horizontally extending portion of the second spacing element.

* * * * *